US007802347B2

(12) United States Patent
Tachi et al.

(10) Patent No.: US 7,802,347 B2
(45) Date of Patent: Sep. 28, 2010

(54) SLIDE FASTENER SLIDER

(75) Inventors: Yukari Tachi, Toyama-ken (JP); Keiichi Keyaki, Toyama-ken (JP); Yoshihiro Kousaka, Toyama-ken (JP)

(73) Assignee: YKK Corporation, Tokyo (JP)

( * ) Notice: Subject to any disclaimer, the term of this patent is extended or adjusted under 35 U.S.C. 154(b) by 690 days.

(21) Appl. No.: 11/888,609

(22) Filed: Aug. 1, 2007

(65) Prior Publication Data

US 2008/0034559 A1 Feb. 14, 2008

(30) Foreign Application Priority Data

Aug. 9, 2006 (JP) ..... 2006-217116

(51) Int. Cl.
*A44B 19/26* (2006.01)

(52) U.S. Cl. ..... 24/427; 24/429; 24/415

(58) Field of Classification Search ..... 24/415, 24/427, 429

See application file for complete search history.

(56) References Cited

U.S. PATENT DOCUMENTS 3,872,553 A * 3/1975 Moertel ..... 24/428
4,409,705 A * 10/1983 Yuunaga ..... 24/415
4,562,622 A * 1/1986 Takabatake ..... 24/427
5,991,982 A 11/1999 Wakabayashi et al.
6,490,770 B1 * 12/2002 Matsuda et al. ..... 24/428
6,530,132 B2 * 3/2003 Yamagishi et al. ..... 24/427

FOREIGN PATENT DOCUMENTS

EP 0097362 1/1984
EP 1400184 3/2004
JP Y2-63-5533 2/1988
JP 3618288 B2 11/2004

OTHER PUBLICATIONS

Search Report dated Nov. 3, 2009, European Application No. 07252910.

* cited by examiner

*Primary Examiner*—Robert J Sandy
(74) *Attorney, Agent, or Firm*—Alston & Bird LLP

(57) ABSTRACT

A slide fastener slider, in which a pair of projecting portions are formed such that they project from shoulder mouth side end portions of a pair of flanges to a shoulder mouth side, the flanges being erected on both right and left sides of a lower plate. Each projecting portion is constituted of a stepped portion formed by extending from the shoulder mouth side end portion of each flange to the shoulder mouth side, and a downward slope formed from the stepped portion up to a top face of the lower plate. The pair of projecting portions allow an inclination of a leg portion of a fastener element to be returned to a substantially horizontal state, thereby preventing contact between a fastener tape and each flange to block breaking of threads in the fastener tape.

2 Claims, 4 Drawing Sheets

SLIDE FASTENER SLIDER

BACKGROUND OF THE INVENTION

1. Field of the Invention

The present invention relates to a slide fastener slider having a pressing face for guiding linear elements while pressing inverted portions of the linear elements.

2. Description of the Related Art

Conventionally, in clothes, bags and the like, slide fasteners have been used to connect composition members such that the members can be opened or closed freely. A slide fastener is constituted of linear elements to be connected when they engage each other, strips of fastener tapes on which the linear elements are mounted in a longitudinal direction, and a slider which slides with the pair of fastener tapes sandwiched in a vertical direction.

The slider is constructed of a slider body in which an upper blade and a lower blade are connected and fixed integrally with a connecting post, and a pull tag. The upper blade comprises an upper plate and a pull tag attaching portion erected on the upper portion of the upper plate. The pull tag attaching portion has a space for attaching the pull tag. The lower blade is constituted of a lower plate.

In the internal structure of some sliders, a pressing face for guiding linear elements while pressing inverted portions of the linear elements is formed on the inner side face of a pair of flanges erected along right and left sides of a lower plate. The pressing face is formed into a step-like shape or a slope shape along a longitudinal direction of each flange, and the pressing face is constructed as a guide on which the inverted portions of the linear elements are mounted.

In general, the linear element is so constructed that with a pair of leg portions parallel to and extending from each coupling head, the end portion of each leg portion is connected to the end portion of a leg portion extending from each adjacent coupling head through an inverted portion. With this configuration, the linear element is constructed into a shape which is bent continuously in a coil-like shape. The inverted portion used in the present invention refers to a portion of the linear element which connects adjacent leg portions on an opposite side to the coupling head, as described above.

There has been proposed a slider in which a pressing face is formed in a step-like shape on a rear mouth side of a flange while it is formed in a slope shape from the step-like portion up to an end portion on a shoulder mouth 50 side of the flange (see Japanese Patent Publication No. 3618288).

A low blade of the slider described in Japanese Patent Publication No. 3618288 is configured such that, as shown in FIG. 7, a pair of flanges 41, 41 are erected along the right and left sides of a lower plate 40 and an elevated portion 44 is formed in the center of the top face of the lower plate 40 from a connecting post 42 to a rear mouth 43. Element guide passages 45 for linear fastener elements (not shown) are provided concavely between the elevated portion 44 and each of the flanges 41, 41.

The pressing faces 46, 46 are provided along the longitudinal direction of the inner side faces of the pair of flanges 41, 41. The pressing face 46, 46 is formed as a stepped portion having a vertically right-angle wall face 47, 47 provided downwardly to the lower plate 40 on the rear mouth 43 side, and formed as a slope face 48, 48 having a downward slope in the direction of the shoulder mouth 50 from the stepped portion. The slope face 48, 48 is expanded gradually from a bent portion 49 of the flange 41, 41 to the shoulder mouth 50 side.

Japanese Utility Model Publication No. 63-5533 has proposed another configuration of a slider in which a pressing face for guiding linear fastener elements while pressing inverted portions of the linear fastener elements. In the configuration of the slider, an intermediate step face is formed projectingly in a horizontal direction continuously from an end portion on a shoulder mouth side of each flange toward the shoulder mouth while the height of the top face of the intermediate step face is formed shorter than the height of the pressing face.

A lower blade of the slider described in Japanese Utility Model Publication No. 63-5533 is configured such that, as shown in FIG. 8, a pair of flanges 61, 61 are erected along the right and left sides of a lower plate 60 and an elevated portion 64 elevated from a connecting post 62 toward a rear mouth 63 is formed in the center of the top face of the lower plate 60.

Pressing faces 65, 65 are provided along a longitudinal direction of the inner side faces of the flanges 61, 61, respectively. The pressing faces 65, 65 are formed in an upward slope from a shoulder mouth 68 side to the rear mouth 63.

Intermediate step faces 66, 66 formed continuously from an end portion of the shoulder mouth 68 side of the flanges 61, 61 are provided projectingly in a horizontal direction toward the shoulder mouth. The height of the top faces thereof are formed smaller than that of the pressing faces 65, 65. The top faces of the intermediate step faces 66, 66 and the top face of the elevated portion 64 are constructed in a substantially the same height from the top face of the lower plate 60. Consequently, the elements can be stride over between the intermediate step face 66 and the elevated portion 64, so that a leg portion between an inverted portion and a coupling head of an element (not shown) is placed in a substantially horizontal state.

An element guide passage 67 is provided concavely between the elevated portion 64 and the intermediate step faces 66, 66, respectively.

In a slide fastener comprising linear elements for use in bags etc., a pull tag is often pulled upward or a slider is pulled upward when the slide fastener is opened or closed by sliding the slider. For this reason, the fastener tape is likely to be inclined so largely that it makes contact with a lower plate near an end edge portion on the shoulder mouth side of a flange of the slider. When the fastener tape is inclined so largely that it makes contact with the lower plate near the end edge portion on the shoulder mouth side of the flange, the fastener tape between elements and the end edge portion on the shoulder mouth side of the flange make a firm contact with each other.

If the slider continues to be slid in this firm contact state, a friction occurs between the bottom face of the fastener tape and the end edge portion on the shoulder mouth side of the flange, so that sometimes a thread in the fastener tape is broken.

In the conventional slider as described in Japanese Patent Publication No. 3618288, a downward slope 48 is formed such that it expands gradually from the height of a substantially intermediate position in the height direction of the flange 41 to the lower plate 40, the slope 48 extending from the bent portion 49 on the inner side face of each flange 41 to an end edge portion on the shoulder mouth side.

In a slider having such a structure, even when a lateral pulling force is applied to linear elements (not shown) to cause individual elements to be inclined, the inverted portions of the elements slide on the slope 48 and are pushed up, so that the inverted portions are guided up to the pressing face 46 in a pushed-up state. Consequently, the inclination of the fastener tape near the end edge portion on the shoulder mouth side of the flange 41 is controlled to be smooth forcibly.

When the inverted portions of the elements are sequentially carried onto the pressing face 46 on the rear mouth 43 side of each flange 41 in this state, the fastener tape is kept in a substantially horizontal state. As a consequence, the fastener tape (not shown) can be moved relative to the slider without making sliding contact with the top face of each flange 41 and a top plate (not shown) between the top plate and the lower plate 40. This makes it possible to prevent sliding contact between the fastener tape and the top face of the flange 41.

When a lateral pulling force is applied to an element at a position in an interval from the bent portion 49 of the flange 41 to the end edge portion on the shoulder mouth side before the inverted portion of the element rides on the pressing face 46, the inverted portion of the element rolls on the slope, so that the fastener tape between the elements does not turn to a horizontal state but is inclined. Particularly, the interval between the end edge portion of the flange 41 on the shoulder mouth 50 side and the end edge portion on the rear mouth 43 side of the connecting post 42 in the back-forth direction of the slider is formed wide. For this reason, when the lateral pulling force is applied to the element at any position between the bent portion 49 of the flange 41 and the shoulder mouth side end edge portion, the leg portion of the element is inclined easily, so that the fastener tape does not turn to the horizontal state but is inclined.

When the leg portion of the element is inclined, the height position of the fastener tape in a region between the bent portion 49 of the flange 41 and the shoulder mouth side end edge portion becomes lower than the top face of each flange 41. Thus, although the fastener tape is raised relative to the top face of the flange 41 across the bent portion 49 of each flange 41 on the rear mouth side, it is lower than the top face of each flange on the shoulder mouth 50 side.

Consequently, the fastener tape turns to a state directed obliquely upward toward the shoulder mouth 50 side across the bent portion 49 of each flange 41. On the other hand, the bottom face of the fastener tape is inclined relative to the end edge portion on the shoulder mouth side of each flange, so that the bottom face of the fastener tape makes contact with the end edge portion on the shoulder mouth side of the flange as if it is pulled up from the bottom. If the slider is still slid in this state, the breaking of threads occurs in the fastener tape due to friction by sliding contact with the end edge portion on the shoulder mouth side of the flange.

In the slider as disclosed in Japanese Utility Model Publication No. 63-5533, the intermediate step face 66 continuous from the shoulder mouth side end portion of each flange 61 is provided projectingly in the horizontal direction toward the shoulder mouth 68.

The provision of this intermediate step face 66 gives the following advantage. That is, even when the lateral pulling force is applied to the element nearer the shoulder mouth 68 side than the end edge portion on the shoulder mouth side of each flange 61, the leg portion of the element can be supported by the elevated portion 64 formed in the center of the top face of the lower plate 60 and the intermediate step face 66. Consequently, the leg portion between the inverted portion and the coupling head of the element can be prevented from being inclined without turning to the horizontal state, thereby preventing the fastener tape portion between the elements from being inclined.

Moreover, the fastener tape and the slider can be moved relative to each other while preventing the fastener tape portion between the elements from being inclined. With this configuration, as the height position of the fastener tape, it can be maintained at a position between the top plate (not shown) and the top face of the flange 61, thereby preventing the fastener tape from making contact with the top face of the flange 61 and the shoulder mouth side end edge portion.

When the lateral pulling force is applied to the element supported in a substantially horizontal state between the elevated portion 64 and the intermediate step face 66, the leg portion of the element can be supported in the substantially horizontal state not so as to be inclined by the elevated portion 64 and the intermediate step face 66. However, when the leg portion of the element goes out of the support by the elevated portion 64 and the intermediate step face 66, and the leg portion is inclined, the inclined leg portion of the element cannot be returned to the substantially horizontal state.

When the fastener tape enters the slider body in a state in which the leg portion between the inverted portion and the coupling head of the element is kept inclined without turning to the substantially horizontal state, the height position of the fastener tape becomes lower than the top face of each flange.

Accordingly, the bottom face of the fastener tape makes contact with the shoulder mouth side end edge portion of each flange. If the slider is slid in this state, a frictional force occurs by sliding contact between the shoulder mouth side end edge portion and the fastener tape, so that breaking of threads is brought about in the fastener tape due to friction.

SUMMARY OF THE INVENTION

The present invention has been made to solve the above-described problem, and an object of the invention is to provide a slide fastener slider capable of preventing generation of breaking of threads in a fastener tape even if the slide fastener is opened/closed with the slider carried upward by pulling a pull tag upward.

The above-described object is achieved by a slide fastener slider comprising: a slider body in which an element passage allowing linear elements to pass therethrough is formed between an upper plate and a lower plate by connecting the upper plate and the lower plate with a connecting post; a pair of flanges which are erected extending from a rear mouth side toward a shoulder mouth side of the slider body along both right and left sides of the lower plate; and pressing faces which are formed on inner side faces of the flanges along a longitudinal direction of the flanges, for guiding the linear elements passing through the element passage while pressing inverted portions of the linear elements, being characterized in that the slide fastener slider further comprises: projecting portions which are formed so as to extend in a direction to the shoulder mouth side from shoulder mouth side end portions of the flanges, in which the projecting portions comprise stepped portions having a smaller height than top faces of the flanges; and downward slopes formed from the stepped portions to a top face of the lower plate, the downward slopes being formed in a continuous shape from the inner side faces of the flanges to outer side edges of the lower plate on the shoulder mouth side while being continuous to the pressing faces.

The present invention possesses a stepped portion extending from the end portion on the shoulder mouth side of each flange to the shoulder mouth side and a downward slope formed from the stepped portion up to the top face of the lower plate.

Even if a lateral pulling force is applied to the elements and the fastener tape invades into the slider body with the leg portion between the inverted portion and the coupling head of the element inclined without turning to a substantially horizontal state, the inverted portion of the element can be pushed up by being guided on the downward slope formed from the stepped portion to the top face of the lower plate. Accordingly, the element can be introduced to the stepped portion while pushing up the inverted portion or with the inverted portion pushed up. Thus, the leg portion of the element is returned forcibly to a substantially horizontal state on the shoulder mouth side compared to the end edge portion of the shoulder mouth side of each flange.

Consequently, at the time when at least the inverted portion of the element is pushed onto the stepped portion, as the height position of the fastener tape, the fastener tape can be located higher than the top face of each flange between the top plate and the lower plate. This makes it possible to prevent contact between the end edge portion on the shoulder mouth side of each flange and the bottom face of the fastener tape, thereby preventing generation of friction due to sliding contact between the bottom face of the fastener tape and the end edge portion on the shoulder mouth side of the flange to block breaking of threads in the fastener tape.

The downward slope is formed in a shape continuous from the inner side face side of each flange to the outer side edge of the lower plate on the shoulder mouth side. With this configuration, the inverted portion of the element invading from the shoulder mouth is slid and guided smoothly from the shoulder mouth side of the downward slope to the inner side face side and pushed up to the stepped portion.

Preferably, bottom end edges of the slopes extending in the direction to the shoulder mouth side in a back-forth direction of the slider is located closer to the shoulder mouth side than an arrangement position of an end edge portion on the rear mouth side of the connecting post. With this configuration, an interval between the downward slope extending to the shoulder mouth side and the connecting post can be constructed as an extension passage in the right-left direction of the element passage. Thus, even if the lateral pulling force is applied to the element on the end edge portion on the shoulder mouth side of the flange, the leg portion of the element is never inclined easily, so that the fastener tape can be kept in a horizontal state.

As a consequence, the inverted portion of the element can be pushed up along the slope securely at a stage that the coupling heads are guided by the connecting post before the coupling heads of the elements engage each other. Accordingly, even if the leg portion between the inverted portion and the coupling head of the element is not in a substantially horizontal state but inclined when the fastener tape invades from the shoulder mouth into the slider body, the leg portion can be returned to the substantially horizontal state by the downward slope.

Because the leg portions can be kept in the substantially horizontal state before the elements engage each other, right and left elements can be engaged with each other securely. Therefore, so-called chain breaking phenomenon that the right and left elements fail to engage each other can be prevented securely. The effects which the present invention exerts are considerably great.

DESCRIPTION OF THE PREFERRED EMBODIMENTS

Hereinafter, a preferred embodiment of the present invention will be described specifically with reference to the accompanying drawings. The present invention is not restricted to any particular embodiment but may be modified in various ways as long as substantially the same components as the present invention are possessed and the same operation and effect are achieved. In the present invention, for example, the shape, arrangement, configuration and the like of the slide fastener slider are not restricted to the configuration of embodiment described below and may be changed appropriately depending on a necessity.

First Embodiment

Figure 1:
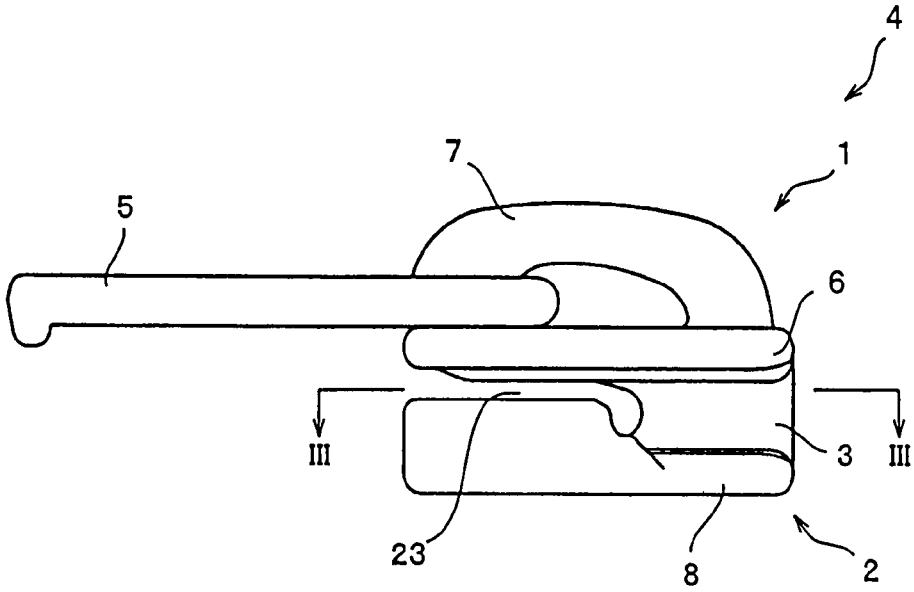
FIG. 1 is a side view showing a slide fastener slider according to an embodiment of the present invention (first embodiment)
Figure 2:
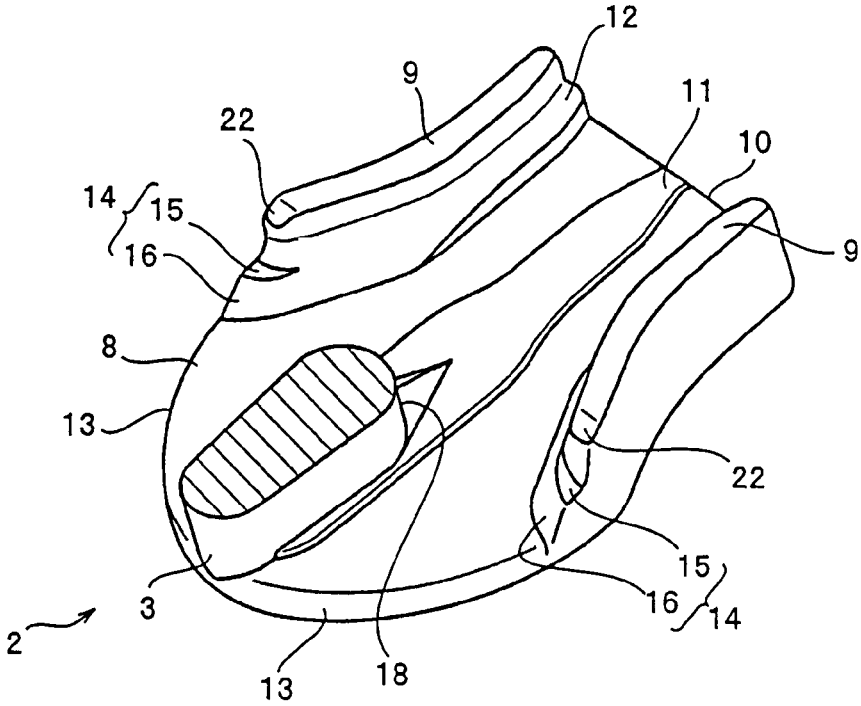
FIG. 2 is an entire perspective view of a lower blade when viewed from above (first embodiment)
Figure 3:
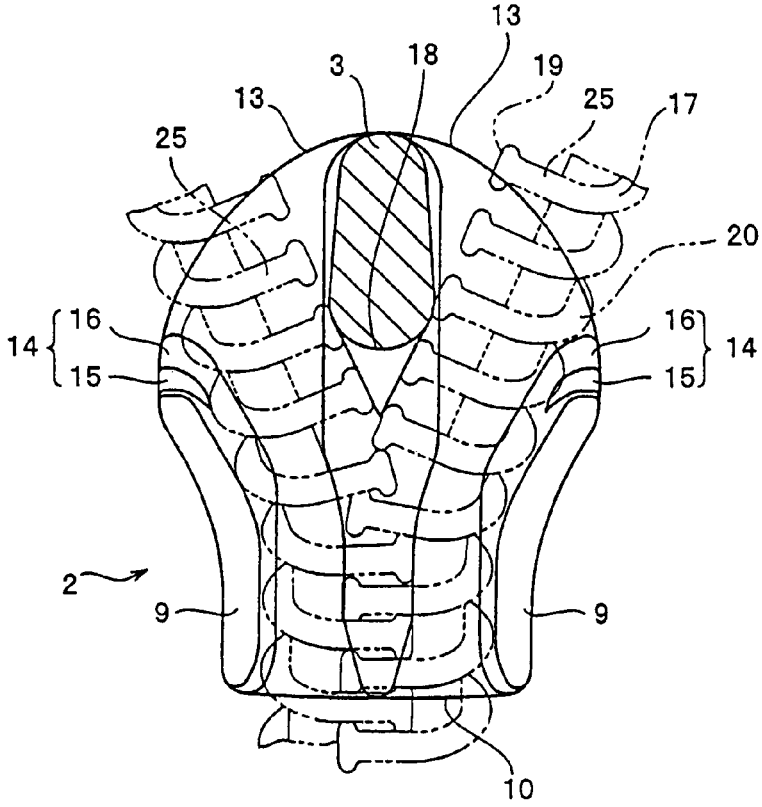
FIG. 3 is a sectional view taken along the line III-III in FIG. 1 (first embodiment)
Figure 4:
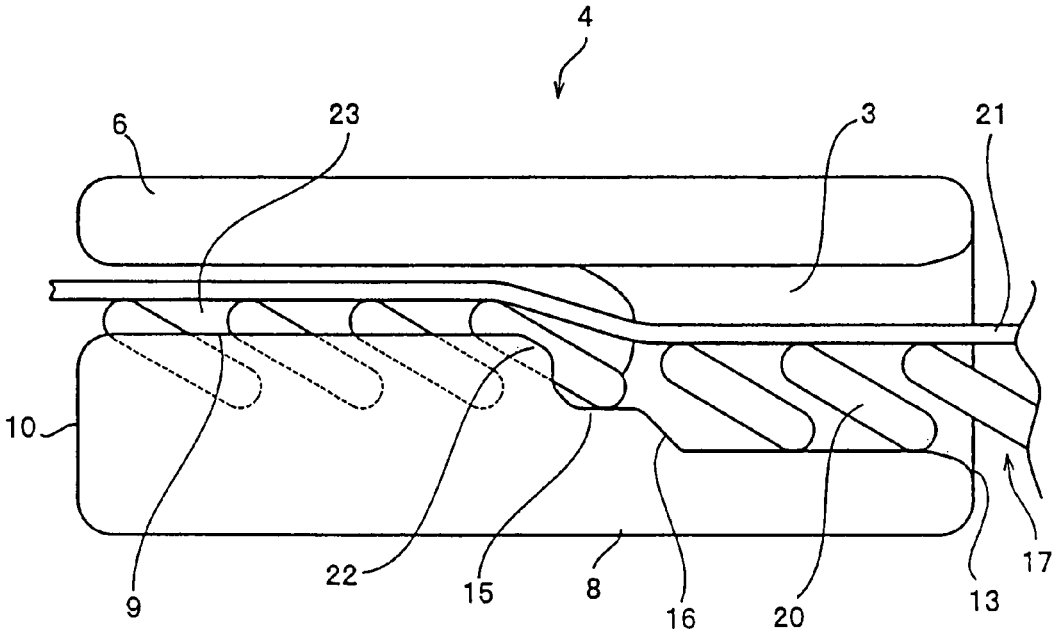
FIG. 4 is a partial side view of the slide fastener slider.
Figure 5:
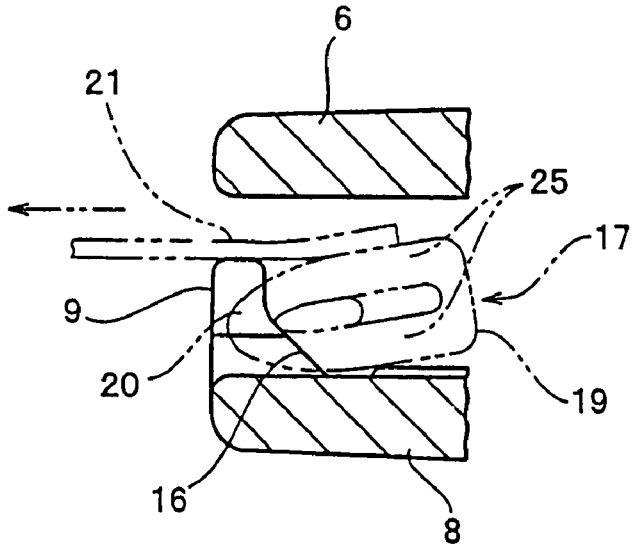
FIG. 5 is a sectional view of major portions of the slide fastener slider before the posture of an element is displaced (first embodiment)
Figure 6:
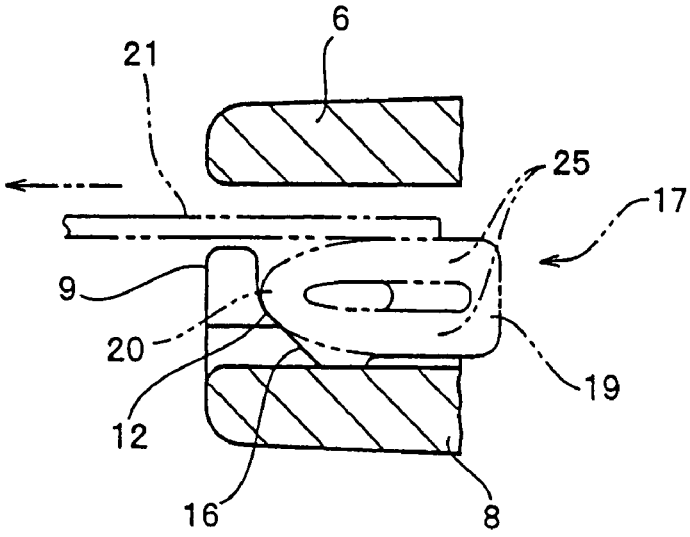
FIG. 6 is a sectional view of major portions of the slide fastener slider after the posture of the element is displaced (first embodiment)
Figure 7:
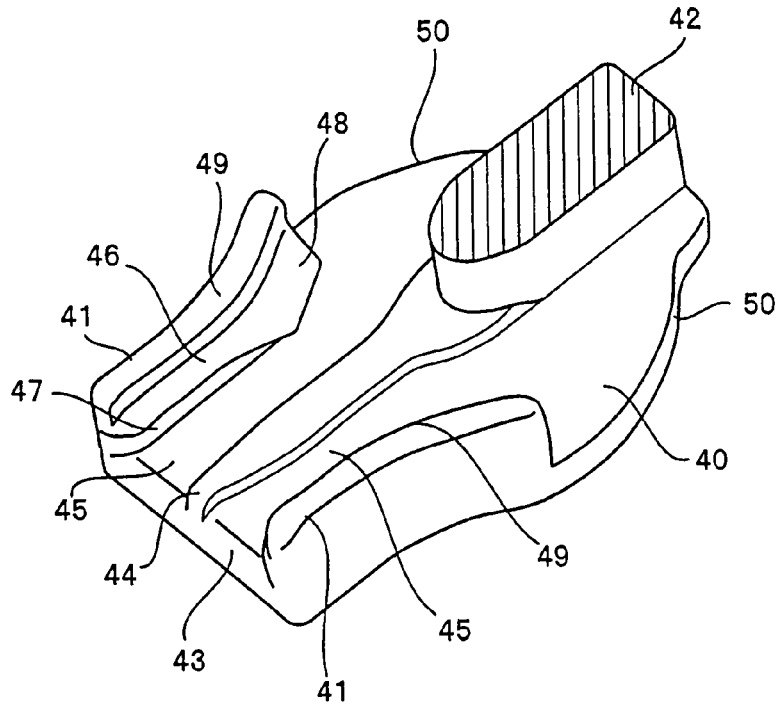
FIG. 7 PRIOR ART
FIG. 7 is an entire perspective view of a lower blade (conventional example)
Figure 8:
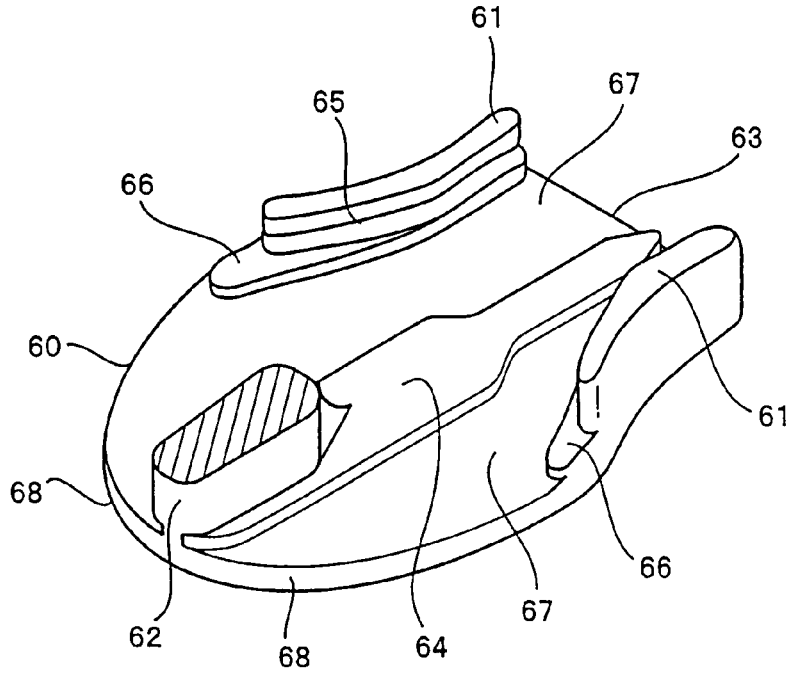
FIG. 8 PRIOR ART
FIG. 8 is an entire perspective view of the lower blade (conventional example).

FIG. 1 is a side view of a slide fastener slider according to an embodiment of the present invention. FIG. 2 is an entire perspective view of a lower blade of the slide fastener slider of the invention when viewed from above. FIG. 3 is a sectional view taken along the line III-III in FIG. 1. FIG. 4 is a partial sectional view of the slide fastener slider of the invention. FIG. 5 is a sectional view of major portions of the slide fastener slider before the posture of an element is displaced. FIG. 6 is a sectional view of major portions of the slide fastener slider after the posture of the element is displaced.

As shown in FIG. 1, in the slide fastener slider, an upper blade 1 and a lower blade 2 are connected and fixed integrally with a connecting post so as to configure a slider body 4. A pull tag 5 is provided on the upper blade 1. An element passage 23 is formed inside the slider body 4 such that linear elements 17 can be inserted.

The upper blade 1 is constituted of an upper plate 6 and a pull tag attaching portion 7 erected on the top thereof. A space is formed in the pull tag attaching portion 7 so as to insert one end portion of the pull tag 5 so that the pull tag 5 is attached thereto rotatably. The lower blade 2 is constituted of a lower plate 8. The upper plate 6 and the lower plate 8 are arranged in parallel with a gap in a vertical direction of the slider body 4, and the gap serves as the element passage 23.

The element passage 23 is extended in a back-forth direction of the slider body 4. The slider body 4 has shoulder mouths 13, which allow the linear elements 17 in a separated state to be inserted, at its front end side thereof, and a rear mouth 10, which allows the linear elements 17 in an engagement state to pass therethrough, at the rear end side thereof.

As shown in FIG. 2, a pair of flanges 9, 9 extending from the rear mouth 10 side of the slider body 4 to the shoulder mouth 13 side are erected along the right and left side edges of the lower plate 8. Pressing faces 12, 12 for guiding the linear elements 17 passing through the element passage 23 while pressing inverted portions 20 of the linear elements 17 are formed along a longitudinal direction of each flange 9, 9 on the inner side faces of the flanges 9, 9. A tape groove which allows a fastener tape 21 to pass therethrough is provided between the top face of the flange 9 and the top plate 6.

Projecting portions 14, 14 are formed such that they extend from the end portion on the shoulder mouth 13 side of each flange 9, 9, and have stepped portions 15, 15 having a smaller height than the top face of each flange 9, 9 on the top face of each projecting portion 14. Downward slopes 16, 16 are formed from the periphery of each stepped portion 15 up to the top face of the lower plate 8.

Each downward slope 16, 16 is formed in a continuous shape from the inner face side of the flange 9, 9 toward the outer side edge of the lower plate 8 on the shoulder mouth 13 side along the periphery of the stepped portion 15, 15. Each downward slope 16, 16 is formed as a face continuous to each pressing face 12, 12. The projecting portion 14 is constructed of the stepped portion 15 and the downward slope 16. Each downward slope 16, 16 may be formed up to the outer side edge of the lower plate 8 or up to just before the outer side edge of the lower plate 8.

An elevated portion 11 is formed in the center of the top face of the lower plate 8 such that it is elevated from the connecting post 3 to the rear mouth 10.

The pressing faces 12, 12 are projected toward the element passage 23 from the inner side faces of the flanges 9, 9, and the projecting shape is different between that of the rear mouth 10 side and that of the shoulder mouth 13 side across an intermediate position in the longitudinal direction of each flange 9, 9. The rear mouth 10 side of the pressing face 12, 12 is formed as a step having a vertically right-angle wall face directed to the lower plate 8. This step is arranged at the intermediate position in the vertical direction of each flange 9, 9, and the top face of the step is formed as a downward slope directed from the inner side face side of each flange 9, 9 to the top end of the right-angle wall, or to the inside of the element passage 23.

On the other hand, a downward slope directed to the lower plate 8 is formed on the shoulder mouth 13 side of each pressing face 12, 12 instead of the step having the right-angle wall face vertically. The stepped portion 15 of the projecting portion 14 is arranged at substantially the same height position as the top end of the right-angle wall face and at a height position lower than the height of the pressing face 12, 12 formed on the top face of the vertically right-angle wall face on the rear mouth 10 side.

As shown in FIG. 3, the lower end on the shoulder mouth 13 side of each downward slope 16, 16 can be extended more with respect to the position of an end edge portion 18 on the rear mouth side of the connecting post 3 in the back-forth direction of the lower blade 2. As a consequence, an interval between the downward slope 16 and the connecting post 3 extending in the direction of the shoulder mouth 13 can be constructed as an extending passage for restricting the right-left direction of the element passage 23.

Accordingly, when the linear elements 17 enter from the shoulder mouth 13 side, a coupling head 19 is guided by the connecting post 3 while the inverted portion 20 is pushed up along the downward slope 16. Because each downward slope 16, 16 is formed in a continuous shape from the inner side face of each flange 9, 9 toward the outer side edge of the lower plate 8 on the shoulder mouth 13 side, the fastener tape can be guided securely for entering the slide body from the shoulder mouth 13. In addition, the opening area of the shoulder mouth 13 can be expanded, thereby facilitating invasion of the fastener tape into the slide body.

Consequently, even if the linear elements 17 enter from the shoulder mouth 13 side with their leg portions inclined, they can be returned from an inclined state to a substantially horizontal state by the downward slope 16. Even if the linear elements enter from the shoulder mouth 13 side with the leg portions 25 inclined without being turned to the substantially horizontal state, the fastener tapes enter the slider body 4 smoothly and the leg portions 25 between the inverted portion 20 and the coupling head 19 can be returned to the substantially horizontal state before the linear elements 17 engage each other. Therefore, right and left elements can be engaged with each other securely. Accordingly, so-called chain breaking phenomenon that the right and left elements fail to engage each other can be prevented.

As shown in FIG. 4, the linear element 17 having entered from the shoulder mouth 13 of the slider body 4 is moved to the rear mouth 10. Because each downward slope 16, 16 is formed to be continuous to the pressing face 12, 12, the inverted portion 20 is introduced continuously to the pressing face 12 (not shown) stably while being raised along the downward slope 16. Thereafter, the inverted portion 20 is placed on the pressing face 12 and guided up to the rear mouth 10.

In a case where a lateral pulling force is applied to the linear element 17 when the linear element 17 is located on the shoulder mouth side with respect to the downward slope 16, the linear element 17 is inclined such that it rolls in the direction of being pulled as shown in FIG. 5. More specifically, as for the positional relation of height between the inverted portion 20 and the coupling head 19, the inverted portion 20 goes down while the coupling head 19 side goes upward, so that the leg portion 25 is inclined.

In this state, the fastener tape 21 attached to the linear element 17 is also inclined in the same direction as the leg portion 25, so that the bottom face of the fastener tape 21 is lower than the bottom face of the fastener tape 21 with the leg portion 25 being in a substantially horizontal state. In FIG. 5, the bottom face of the fastener tape 21 and the top face of the flange 9 are described in the same height. However, the inclination between the inverted portion 20 and the coupling head 19 in terms of the positional relation of height is further increased by the magnitude of the lateral pulling force applied to the linear element 17, so that the bottom face of the fastener tape 21 is sometimes located below the top face of the flange 9.

However, according to the present invention, even when the lateral pulling force is applied to the linear element 17, the inverted portion 20 is raised along the slope face 16 as shown in FIGS. 4 and 6, so that positional relation of the leg portion 25 between the inverted portion 20 and the coupling head 19 can be returned to a substantially horizontal state. Consequently, as shown in FIG. 6, the inclination of the portion of the fastener tape 21 between the inverted portion 20 and the coupling head 19 turns to a substantially horizontal state, which allows the height position of the bottom face of the fastener tape 21 to be set higher than the top face of the flange 9.

The configuration of the present invention, as shown in FIG. 4, prevents contact between the shoulder mouth side end edge portion of the flange 9 and the bottom face of the fastener tape 21, thereby preventing the bottom face of the fastener tape 21 from making sliding contact with the shoulder mouth side end edge portion of the flange 9. Thus, the present invention can prevent breaking of threads from occurring in the fastener tape 21 due to friction generated when the bottom face of the fastener tape 21 and the shoulder mouth side end edge portion of the flange 9 make sliding contact with each other.

As shown in FIG. 2, chamfered portions 22 can be provided by chamfering the corners of the shoulder mouth side end edge portions of the flanges 9, 9. This makes it possible, as shown in FIG. 4, to prevent contact between the bottom face of the fastener tape 21 and the shoulder mouth side end edge portion of the flange 9 more securely. In addition, even if the fastener tape makes contact with the corner, the breaking of threads in the fastener tape 21 due to friction can be prevented because the contact face of the flange with the bottom face of the fastener tape 21 is of a smooth surface formed by chamfering.

The present invention can be applied effectively to a slide fastener which is opened/closed with a slider pulled upward.

The invention claimed is:

1. A slide fastener slider, comprising:

a slider body in which an element passage allowing linear elements to pass therethrough is formed between an upper plate and a lower plate by connecting the upper plate and the lower plate with a connecting post;

a pair of flanges which are erected extending from a rear mouth side toward a shoulder mouth side of the slider body along both right and left sides of the lower plate; and pressing faces which are formed on inner side faces of the flanges along a longitudinal direction of the flanges, for guiding the linear elements passing through the element passage while pressing inverted portions of the linear elements, wherein the slide fastener slider further comprises:

projecting portions which are formed so as to extend in a direction to the shoulder mouth side from shoulder mouth side end portions of the flanges, in which the projecting portions comprise stepped portions having a smaller height than top faces of the flanges; and downward slopes formed from the stepped portions to a top face of the lower plate, the downward slopes being formed in a continuous shape from the inner side faces of the flanges to outer side edges of the lower plate on the shoulder mouth side while being continuous to the pressing faces.

2. The slide fastener slider according to claim 1, wherein bottom end edges of the slopes extending in the direction to the shoulder mouth side in a back-forth direction of the slider is located closer to the shoulder mouth side than an arrangement position of an end edge portion on the rear mouth side of the connecting post.

* * * * *